US006747567B2

(12) United States Patent
Amano et al.

(10) Patent No.: US 6,747,567 B2
(45) Date of Patent: Jun. 8, 2004

(54) REMOTE CONTROLLED ELECTRONIC APPARATUS AND REMOTE CONTROL METHOD THEREOF

(75) Inventors: Toshio Amano, Kanagawa (JP); Kenichi Konuma, Tokyo (JP); Toshihisa Ueki, Aichi (JP)

(73) Assignee: Sony Corporation, Tokyo (JP)

( * ) Notice: Subject to any disclaimer, the term of this patent is extended or adjusted under 35 U.S.C. 154(b) by 473 days.

(21) Appl. No.: 09/804,850

(22) Filed: Mar. 13, 2001

(65) Prior Publication Data

US 2002/0030603 A1 Mar. 14, 2002

(30) Foreign Application Priority Data

Mar. 15, 2000 (JP) ..... P2000-077795

(51) Int. Cl.[7] ..... G08C 19/00

(52) U.S. Cl. ..... 340/825.69; 340/7.32; 340/7.33; 340/7.36; 340/10.3; 340/10.34

(58) Field of Search ..... 340/825.69, 7.32, 340/7.33, 7.36, 7.38, 10.3, 10.34, 825.72, 539.3; 386/46; 455/343.1, 343.2, 296, 307; 361/182

(56) References Cited

U.S. PATENT DOCUMENTS 5,036,261 A * 7/1991 Testin ..... 315/411
5,920,466 A * 7/1999 Hirahara ..... 363/21
6,085,017 A * 7/2000 Rilly ..... 386/46

FOREIGN PATENT DOCUMENTS

| | | | |
|---|---|---|---|
| DE | 3110929 A | 4/1982 | ..... G05B/24/02 |
| EP | 0610700 A | 1/1994 | ..... H04N/5/63 |
| EP | 0766215 A | 9/1995 | ..... G08G/1/17 |
| EP | 0795966 A2 | 3/1997 | ..... H04B/1/16 |

* cited by examiner

*Primary Examiner*—Michael Horabik
*Assistant Examiner*—Vernal Brown
(74) *Attorney, Agent, or Firm*—Jay H. Maioli

(57) ABSTRACT

An electronic apparatus wherein a remote control signal received via a filter is decoded and, upon deciding that the control signal is a power cutoff instruction, a controlling microcomputer outputs a filter control signal for actuating the filter to place the apparatus in a reception standby mode while the microcomputer itself is also set in its low power state, hence preventing a malfunction that some noise derived from external light of a fluorescent lamp or the like is recognized erroneously as a remote control signal and that the apparatus is shifted in error from the low power state to its wake-up mode. Consequently, the power consumption can be reduced in the standby mode. The remote control signal consists of a fixed-width pulse and a succeeding control code, and upon detection of the fixed-width pulse, the controlling microcomputer is released from the low power state to wake up and then halts the operation of the filter.

7 Claims, 8 Drawing Sheets

REMOTE CONTROLLED ELECTRONIC APPARATUS AND REMOTE CONTROL METHOD THEREOF

BACKGROUND OF THE INVENTION

The present invention relates to a remote controlled electronic apparatus equipped with a standby power source kept in an active state even when the electronic apparatus is not in operation.

Most of the recent electronic apparatus are equipped with a light sensor to receive incident light modulated by infrared rays for example, and have a remote control function for operating the electronic apparatus by receiving the infrared rays radiated from a remote controller. In order to utilize such a remote control function, a standby power source is provided therein for holding required data even when the electronic apparatus is not in operation, including the on/off state of a main power source for the electronic apparatus, information relative to a timer for the apparatus, and further manipulative information.

For the purpose of curtailing the standby power, there has been known heretofore a method of setting a controlling microcomputer of the electronic apparatus in a sleep mode at its reception standby time to thereby reduce the power consumption. When the electronic apparatus is placed in a reception standby state, a sleep mode is selected to stop the entire functions of the controlling microcomputer by halting its clock. This mode is used frequently in view of energy saving. When a specific signal is inputted in case the controlling microcomputer is in such a sleep mode, the controlling microcomputer is reset automatically to the former state in response to the input signal. Reset to the former state from the sleep mode is termed "wake-up".

The electronic apparatus is placed in its reception standby state by a control signal transmitted from a remote controller, and then the controlling microcomputer is placed in a sleep mode. In this sleep mode, there may arise a problem that, if any noise derived from external light of a fluorescent lamp or the like is received, such noise may be recognized erroneously as a control signal. In this case, the controlling microcomputer is caused to wake up, and the power is supplied thereto for enabling the microcomputer to decode a remote control signal, whereby it is rendered impossible to achieve the principal purpose of reducing the power consumption in the reception standby mode.

SUMMARY OF THE INVENTION

It is therefore an object of the present invention to accomplish improvements in a remote controlled electronic apparatus, wherein a control signal is supplied via a filter to a control unit, and the filter is actuated in a reception standby mode so as to prevent a microprocessor, which is in a low power state, from being reset by any external light noise, hence suppressing the power consumption. Further, when the controlling microcomputer has been reset to its operating state, the filter is opened so that the apparatus is enabled to respond to a remote control signal.

In the improvement, a plurality of filters may be prepared in such a manner as to be selectively switchable and enhanced functionally in the case of any erroneous operation or malfunction due to some noise, whereby setting can be so performed as to comply with ambient noise in the environment around the electronic apparatus, hence minimizing the erroneous operation and suppressing the power consumption in the reception standby mode.

According to a first aspect of the present invention, there is provided a remote controlled electronic apparatus which comprises a filter for attenuating a noise component included in a remote control signal, and a control unit for decoding the remote control signal transmitted via the filter. In this apparatus, when the remote control signal has been decoded and regarded as a power cutoff instruction, the control unit demagnetizes a relay to place the electronic apparatus in its reception standby mode and to set itself in a low power state, and then outputs a filter control signal to actuate the filter.

According to a second aspect of the present invention, there is provided an electronic apparatus wherein, upon detection of a fixed-width pulse included in a remote control signal, a control unit is caused to wake up from a low power state and then outputs a filter control signal to halt the function of a filter.

According to a third aspect of the present invention, there is provided an electronic apparatus which comprises a filter for attenuating a predetermined frequency component of a remote control signal composed of a fixed-width pulse and a succeeding control code, and a control unit for decoding a remote control signal supplied via a first input terminal, wherein, when the control signal has been regarded as a power cutoff signal, a relay is demagnetized to place the apparatus in its reception standby mode and to set itself in a low power state, thereby disabling the first input terminal from accepting the remote control signal. And in response to the fixed-width pulse included in the remote control signal supplied via the filter at a second input terminal, the control unit releases itself from the low power state and enables the first input terminal to accept the remote control signal again.

According to a fourth aspect of the present invention, there is provided an electronic apparatus wherein, if a control code is not existent within a predetermined time after a release from a low power state to wake up the control unit, another filter control signal is outputted to further enhance the noise eliminating function of the filter, and then the control unit is placed in the low power state again.

According to a fifth aspect of the invention, there is provided an electronic apparatus wherein its low power state is such that a clock or execution of an instruction is at a halt in a control unit.

According to a sixth aspect of the invention, there is provided a remote control method for an electronic apparatus. The method comprises a step of decoding a remote control signal composed of a fixed-width pulse and a succeeding control code; and a step of executing, upon decision that the decoded control signal is a power cutoff instruction, predetermined attenuation of a noise component superposed on the remote control signal to set a control unit in a low power state, and a step of demagnetizing a relay to place the apparatus in a reception standby mode.

According to a seventh aspect of the invention, there is provided a method for remote control of an electronic apparatus by detecting a fixed-width pulse included in a remote control signal, and then releasing the control unit from its low power state while stopping the action of attenuation.

According to an eighth aspect of the invention, there is provided a method for remote control of an electronic apparatus, comprising a step of decoding a remote control signal supplied via a first input terminal and, upon decision that the decoded control signal is a power cutoff instruction, demagnetizing a relay to place the apparatus in a reception standby mode and to set a control unit in a low power state, and disabling the first input terminal from accepting the remote control signal; a step of attenuating a predetermined frequency component of the remote control signal; and a step of making a decision as to whether a fixed-width pulse included in the attenuated remote control signal is existent or not and, upon detection of the fixed-width pulse, releasing the control unit from the low power state and enabling the first input terminal to accept the remote control signal again.

And according to a ninth aspect of the invention, there is provided a method for remote control of an electronic apparatus by releasing the control unit from a low power state to wake up the same and, if a control code is not existent within a predetermined time after such wake-up, outputting another filter control signal different from one filter control signal to thereby further enhance the attenuation of noise, and then placing the control unit in the low power state again.

The above and other features and advantages of the present invention will become apparent from the following description which will be given with reference to the illustrative accompanying drawings.

DETAILED DESCRIPTION OF THE PREFERRED EMBODIMENTS

Hereinafter the present invention will be described in detail with reference to some preferred embodiments shown in the accompanying drawings.

Figure 1:
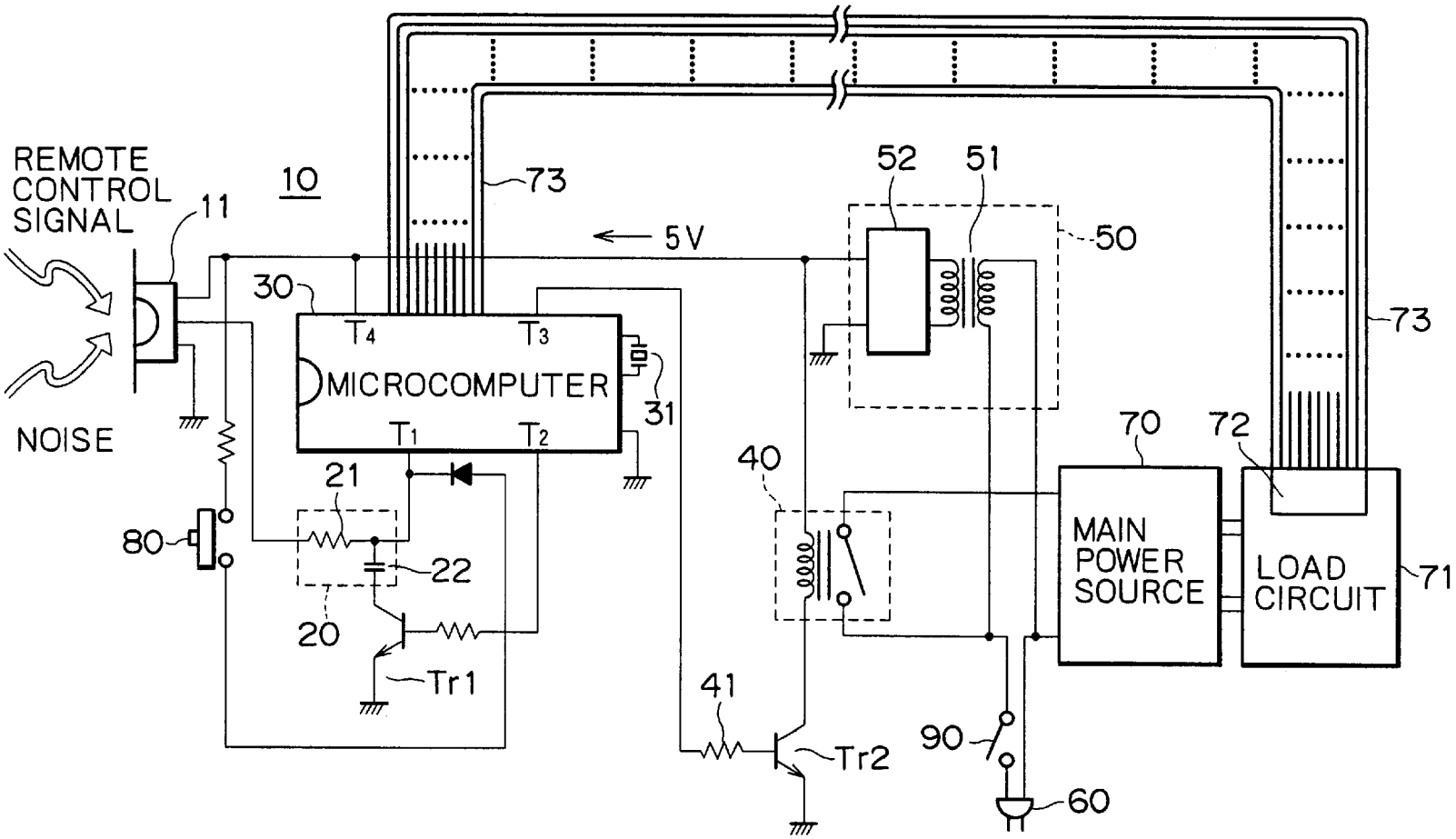
FIG. 1 is a circuit diagram of a remote controlled electronic apparatus in a first embodiment of the present invention.
Figure 2:
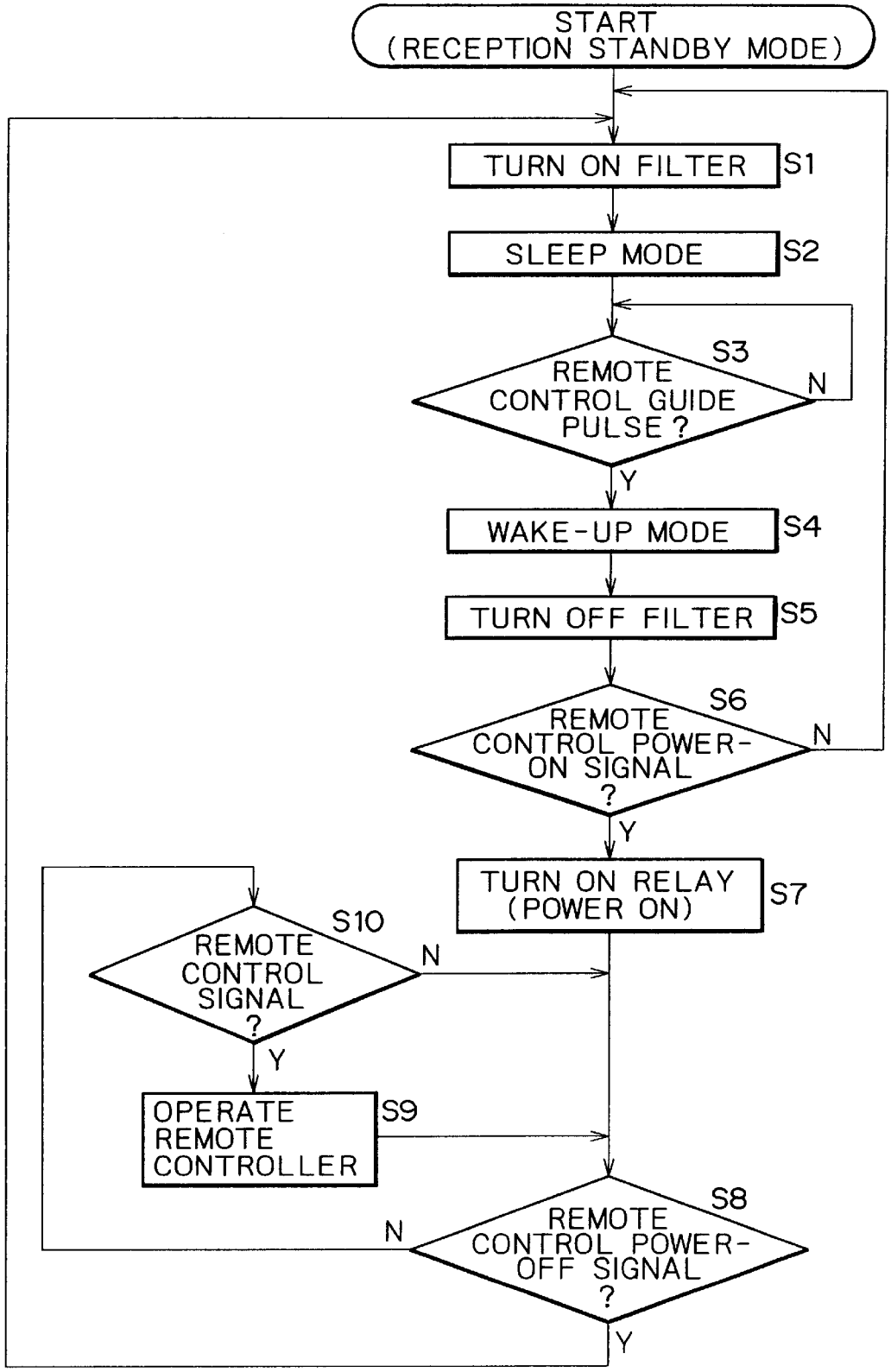
FIG. 2 is a flowchart of a remote control routine executed in a remote controlled receiving apparatus.

To begin with, an explanation will be given on a first embodiment of the invention with reference to FIGS. 1 and 2. FIG. 1 is a circuit diagram schematically showing a power supply line in an electronic apparatus such as a television receiver, a video deck or the like, particularly in a first embodiment of the present invention which represents a remote controlled electronic apparatus. And FIG. 2 is a flowchart of a remote control routine to be executed in such an apparatus.

The remote controlled electronic apparatus 10 in this embodiment comprises a light sensor 11 for receiving a control signal from a remote controller, not shown; a low pass filter 20 consisting of a resistor 21 and a capacitor 22; a transistor Tr1 for controlling the low pass filter 20; a controlling microcomputer 30 having a clock source 31; a standby power source 50 consisting of a transformer 51 and a rectifier circuit 52; a relay switch 40 for turning on a main power source 70 to supply an operating power to a load circuit 71; a transistor Tr2 for driving the relay switch 40; a power switch 90; an AC plug 60; and a signal line 73 for connecting the microcomputer 30 to a system controller 72 of the load circuit 71 so as to control the load circuit 71 by a remote control signal.

The remote controlled electronic apparatus 10 is supplied with an AC power through the AC plug 60, so that a DC voltage of, e.g., 5V obtained from the transformer 51 and the rectifier circuit 52 of the standby power source 50 is supplied to a terminal $T_4$ of the controlling microcomputer 30.

In a wake-up mode, the controlling microcomputer 30 is rendered controllable by means of a remote controller, and a control signal is outputted to the load circuit 71 via the signal line 73.

Figure 3:
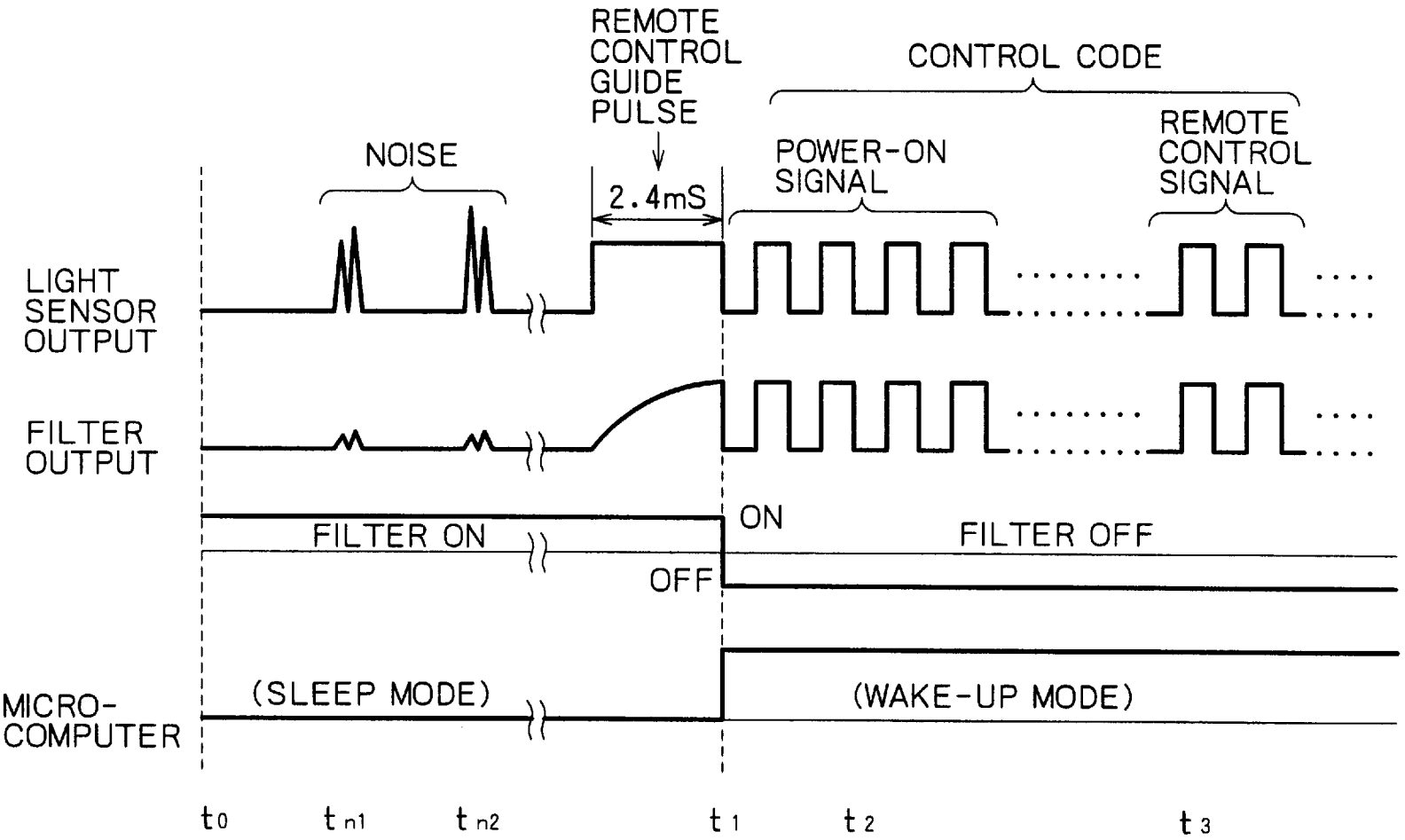
FIG. 3 is a waveform chart of a remote control signal in the first embodiment.

Next, the operation performed in the first embodiment will be described below with reference to a flowchart of FIG. 2 and a waveform chart of FIG. 3 showing the remote control signal.

Suppose now that, in an initial state ($t_0$), the remote controlled electronic apparatus 10 is set in its reception standby mode as the controlling microcomputer 30 executes a power-off control action in response to the remote control signal.

At step S1, the controlling microcomputer 30 outputs, in succession to the power-off control action, a filter control signal from a filter control terminal $T_2$ to turn on the transistor Tr1, thereby actuating the filter 20 to attenuate a high-frequency signal component. At step S2, the controlling microcomputer 30 itself is set in a sleep mode. In this sleep mode, the controlling microcomputer 30 is in a clock halt state.

At step S3 during $t_0$–$t_2$, the microcomputer 30 responds to a guide pulse signal from the remote controller inputted to a wake-up terminal which serves also as a remote control signal input terminal $T_1$. The guide pulse signal from the remote controller has a fixed width of, e.g., 2.4 ms, and this pulse width is detected to be regarded as wake-up.

In the sleep mode, the controlling microcomputer 30 may be placed in a state to halt execution of an instruction without halting the clock source 31. In this case, the controlling microcomputer 30 decodes the control signal immediately after wake-up, hence capable of decoding the control signal as in a normal state.

The signal inputted via the light sensor 11 during the sleep mode is so processed that its high-frequency signal component is attenuated through the filter 20 as represented by the filter output waveform in FIG. 3, whereby any external light noise derived from a fluorescent lamp or the like is eliminated. Consequently, the controlling microcomputer 30 is kept free from erroneously recognizing the noise output of the light sensor 11 as a control signal, thereby removing a failure that the wake-up mode is induced in error by the noise. Therefore, during the time of $t_{n1}$–$t_{n2}$, the controlling microcomputer 30 is maintained in the sleep mode so that a low power consumption is held continuously.

Upon detection of a power-on signal including the guide pulse transmitted from the remote controller, the guide pulse is not attenuated sufficiently in the filter 20, and the filter output therefrom is fed to the terminal $T_1$ of the controlling microcomputer 30. Subsequently the controlling microcomputer 30 recognizes a fall point $t_1$ of the fixed-width guide pulse, and then the operation proceeds from the sleep mode to a wake-up mode at step S4. In this embodiment, it is also possible to wake up the controlling microcomputer 30 by depressing a power key 80 of the electronic apparatus.

After being set in the wake-up mode, the controlling microcomputer 30 outputs, at step S5, a filter control signal from its control terminal $T_2$ to turn off the transistor Tr1, thereby switching off the action of the filter 20.

A control code succeeding the guide pulse is inputted to the controlling microcomputer 30 via the terminal $T_1$, and a decision is made at step S6 as to whether the control code is a power-on signal or not. If the result of this decision is affirmative, a relay-on signal is outputted at step S7 to a relay control terminal $T_3$ to thereby turn on the transistor Tr2, which then drives the relay switch 40 to switch on its contact, whereby a main power is supplied from the main power source 70 to the load circuit 71. Thereafter the operation proceeds to steps S8, S9 and S10, where the electronic apparatus is controlled by manipulation of the remote controller.

If a power-off signal is transmitted from the remote controller when the contact of the relay switch 40 is at its on-position, the operation returns to step S1, so that the controlling microcomputer 30 turns on the action of the filter 20 again, and subsequently the controlling microcomputer 30 is set in the sleep mode at step S2, whereby a low power consumption mode is selected.

Figure 4:
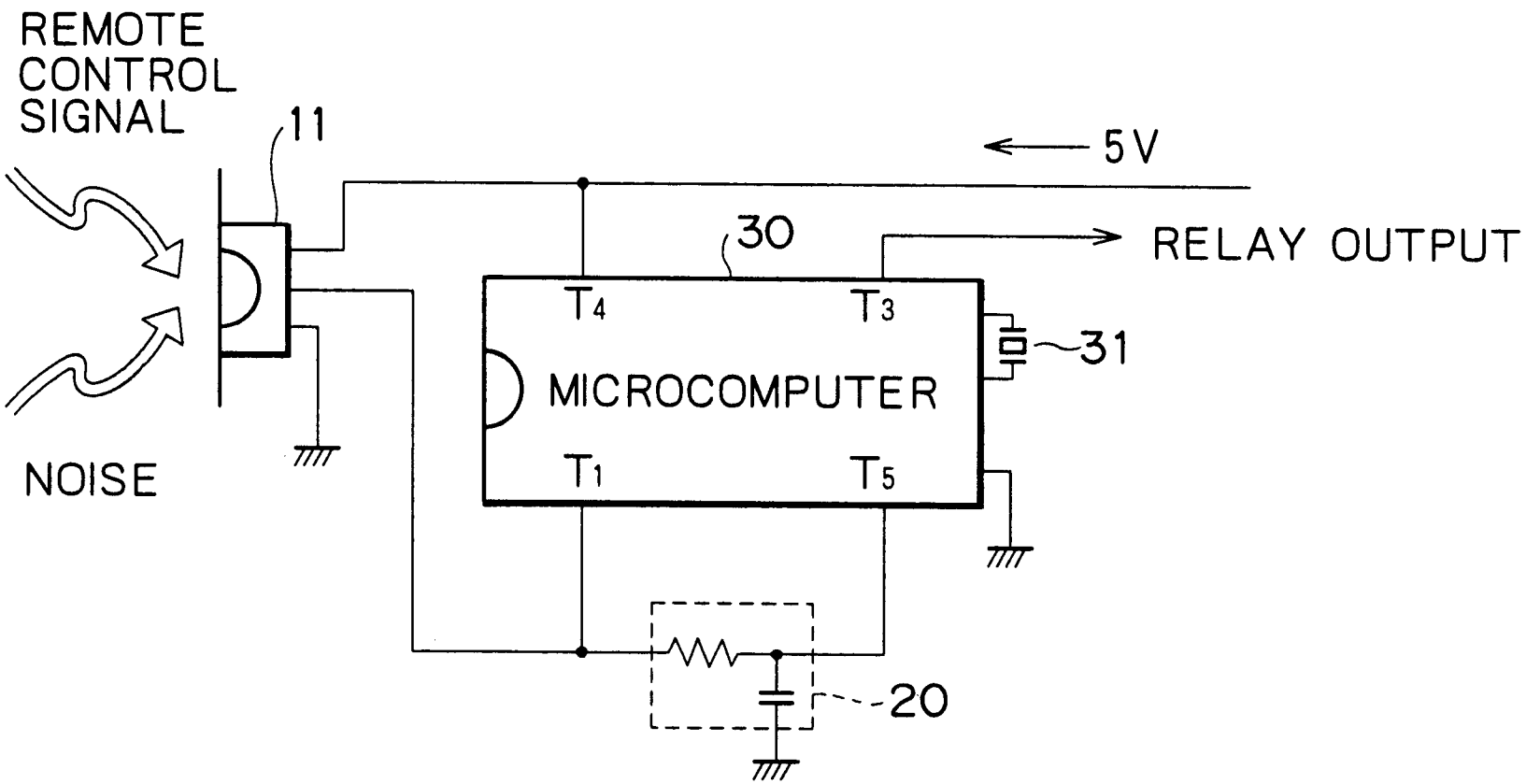
FIG. 4 shows essential component parts of a remote controlled electronic apparatus in a second embodiment of the present invention.
Figure 5:
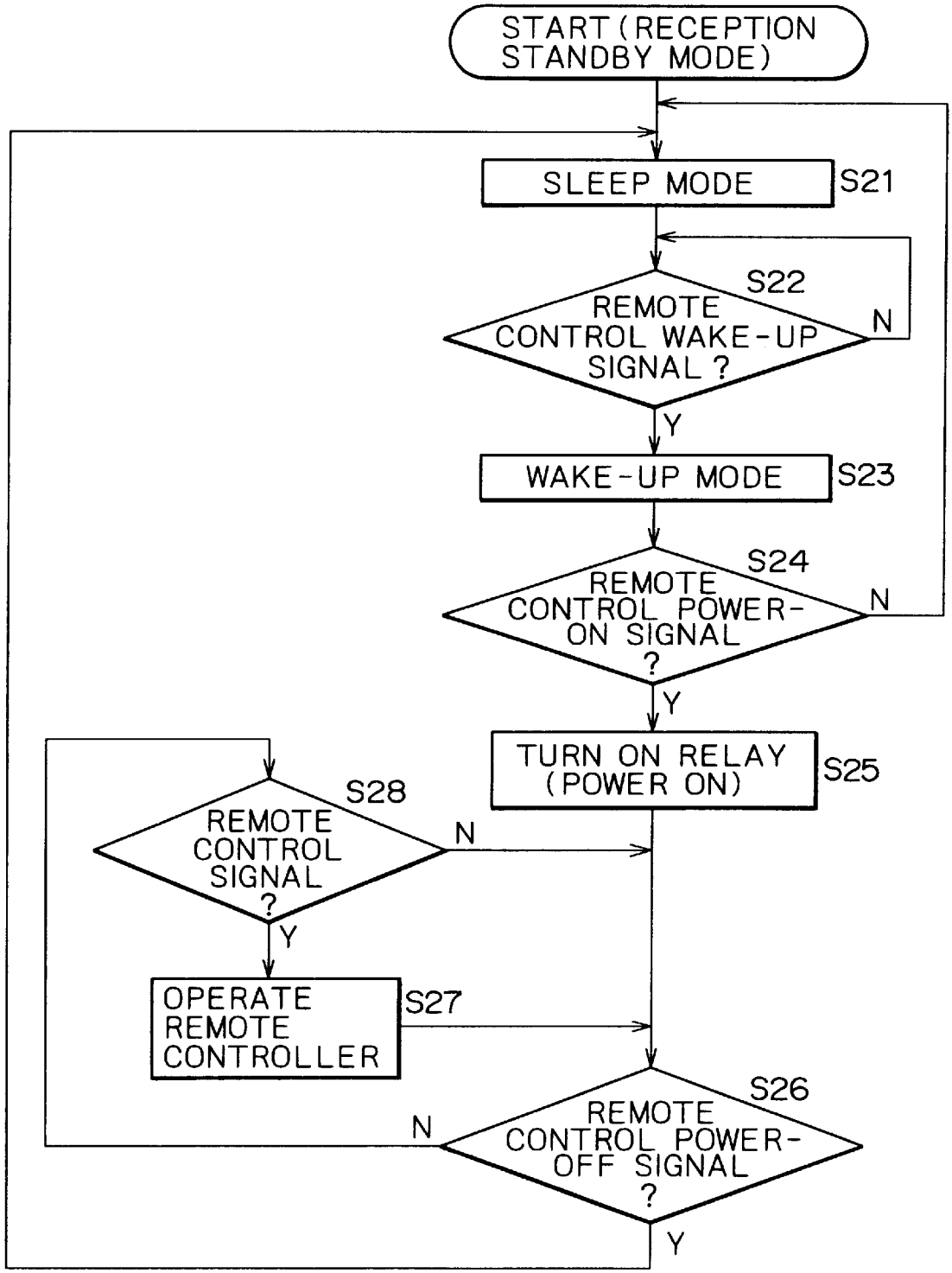
FIG. 5 is a flowchart of a remote control routine executed in the second embodiment of FIG. 4.

FIG. 4 is a partial circuit diagram of a remote controlled electronic apparatus in a second embodiment of the present invention, showing only a light sensor 11 and peripheral circuits around a controlling microcomputer 30. And FIG. 5 is a flowchart of a remote control routine executed therein. As shown in FIG. 4, the controlling microcomputer 30 has an interrupt input terminal $T_5$ responsive to a wake-up signal, and a control signal input terminal $T_1$ not responsive before shift to a wake-up mode.

Now a control flow of the microcomputer 30 will be explained below with reference to the flowchart of FIG. 5. The processing routine starts similarly to FIG. 2, and it is supposed here that the controlling microcomputer 30 has been set in its reception standby mode. At step S21, the controlling microcomputer 30 itself is set in a sleep mode.

At step S22, a decision is made as to whether a wake-up signal is existent or not. When a guide pulse is inputted to the controlling microcomputer 30 via a filter 20 and a terminal $T_5$, the controlling microcomputer 30 proceeds, at step S23, from the sleep mode to the wake-up mode.

At step S24, if a control code succeeding the guide pulse is regarded as a power-on signal, a signal for turning on a relay switch 40 is outputted from a terminal $T_3$, and a power is supplied from a main power source 70 to a load circuit. Since the subsequent operation of the controlling microcomputer 30 is the same as in the aforementioned first embodiment, a repeated explanation thereof is omitted here. However, in this second embodiment, the filter on/off control action is not necessary.

Figure 6:
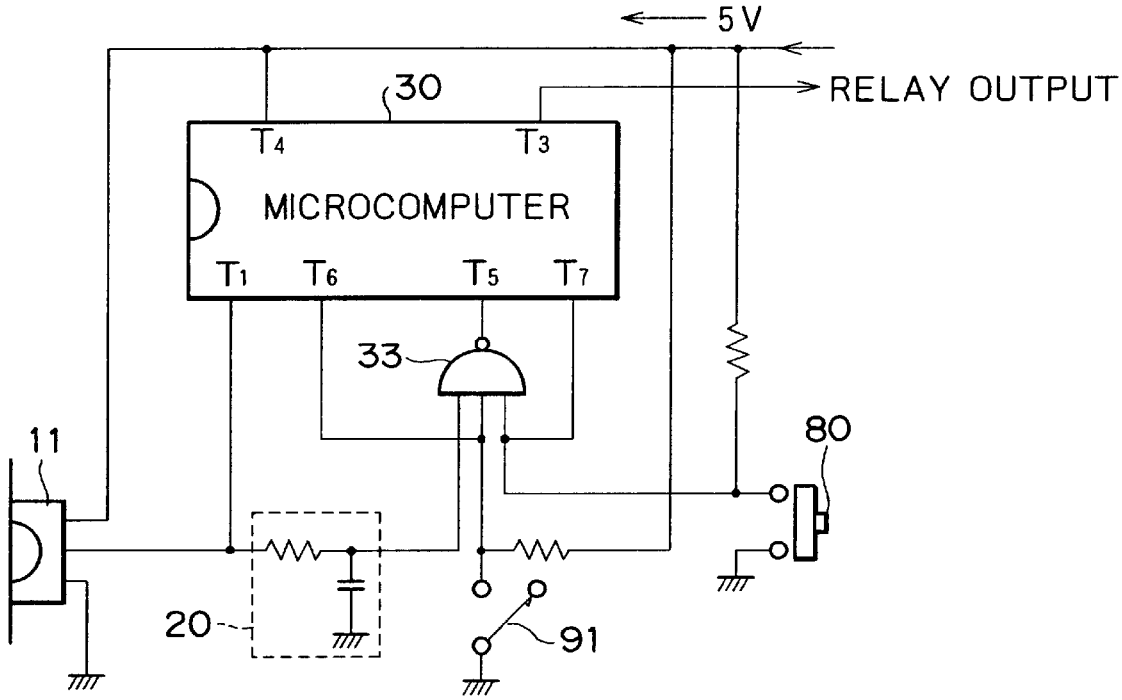
FIG. 6 shows essential component parts of a remote controlled electronic apparatus in a third embodiment of the present invention.

FIG. 6 is a partial circuit diagram of a third embodiment of the present invention, showing only a light sensor 11 and peripheral circuits around a controlling microcomputer 30. As other component parts are the same as those in the first embodiment, a repeated explanation thereof is omitted here.

In the third embodiment, a control signal having passed through a filter 20, an output of a power key 80 and an output of a second power switch 91 are inputted to an external input interrupt terminal $T_5$ via a NAND circuit 33. The power key 80 consists of a push-button switch provided in the electronic apparatus for waking up the controlling microcomputer 30 from its sleep mode. The second power switch 91 consists of a toggle switch or the like to turn on and off the power while interlocking mechanically with the power switch 90 shown in FIG. 1, thereby switching off entire display units relative to the reception standby mode and other modes of a load circuit 71.

In the third embodiment, if either the output of the power key 80 or the output of the second power switch 91 is inputted to the NAND circuit 33 in addition to the output of the filter 20 to which a control signal is supplied, then the external input interrupt terminal $T_5$ is changed to a high (H) level to wake up the controlling microcomputer 30. When a signal is fed to the input terminal $T_7$ of the power key 80 and the input terminal $T_6$ of the second power switch 91, the controlling microcomputer 30 outputs a relay control signal from its terminal $T_3$, so that the power from the main power source 70 is supplied to the load circuit 71.

Figure 7:
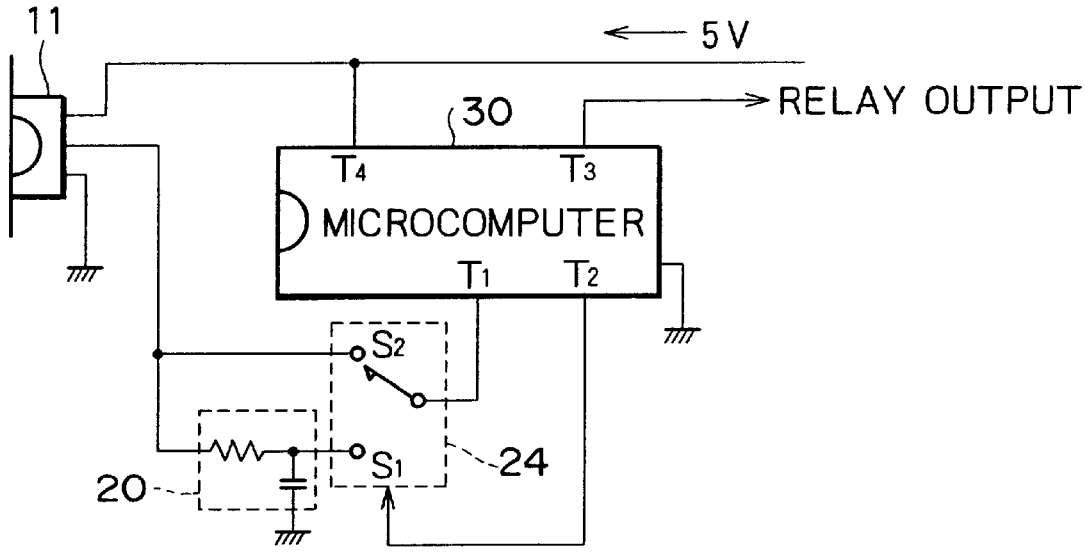
FIG. 7 shows essential component parts of a remote controlled electronic apparatus in a fourth embodiment of the present invention.

FIG. 7 is a partial circuit diagram of a fourth embodiment of the present invention, showing only a light sensor 11 and peripheral circuits around a controlling microcomputer 30. As other component parts are the same as those in the first embodiment, a repeated explanation thereof is omitted here.

In a sleep mode, a switch 24 is connected to its one contact $S_1$ by a filter control signal outputted from a terminal $T_2$. Therefore, a control signal from the light sensor 11 passes through a filter 20. And when this signal is noise, the controlling microcomputer 30 is not actuated to wake up. However, when the signal is a guide pulse of a predetermined width mentioned, the controlling microcomputer 30 is shifted from the sleep mode to the wake-up mode, wherein a filter control signal is outputted from the terminal $T_2$, and the switch 24 is changed to another contact $S_2$. Consequently, a control code succeeding the guide pulse is inputted directly to the terminal $T_1$ of the controlling microcomputer 30 without passing through the filter 20. The operation of shift to a power-on state or reception standby mode after wake-up and also the on/off action of the filter after power-off are the same as those shown in the flowchart of FIG. 2.

Figure 8:
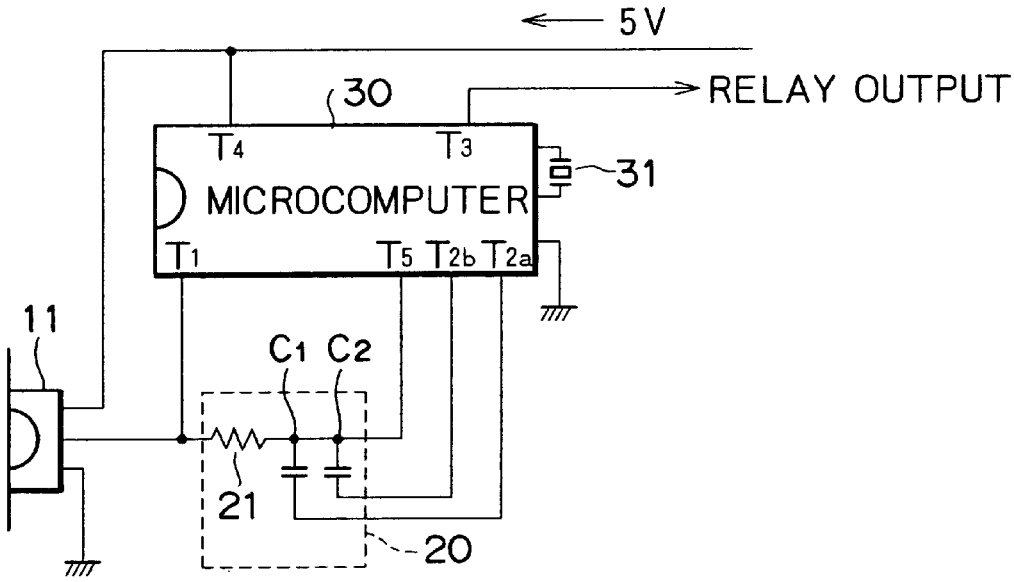
FIG. 8 shows essential component parts of a remote controlled electronic apparatus in a fifth embodiment of the present invention.
Figure 9:
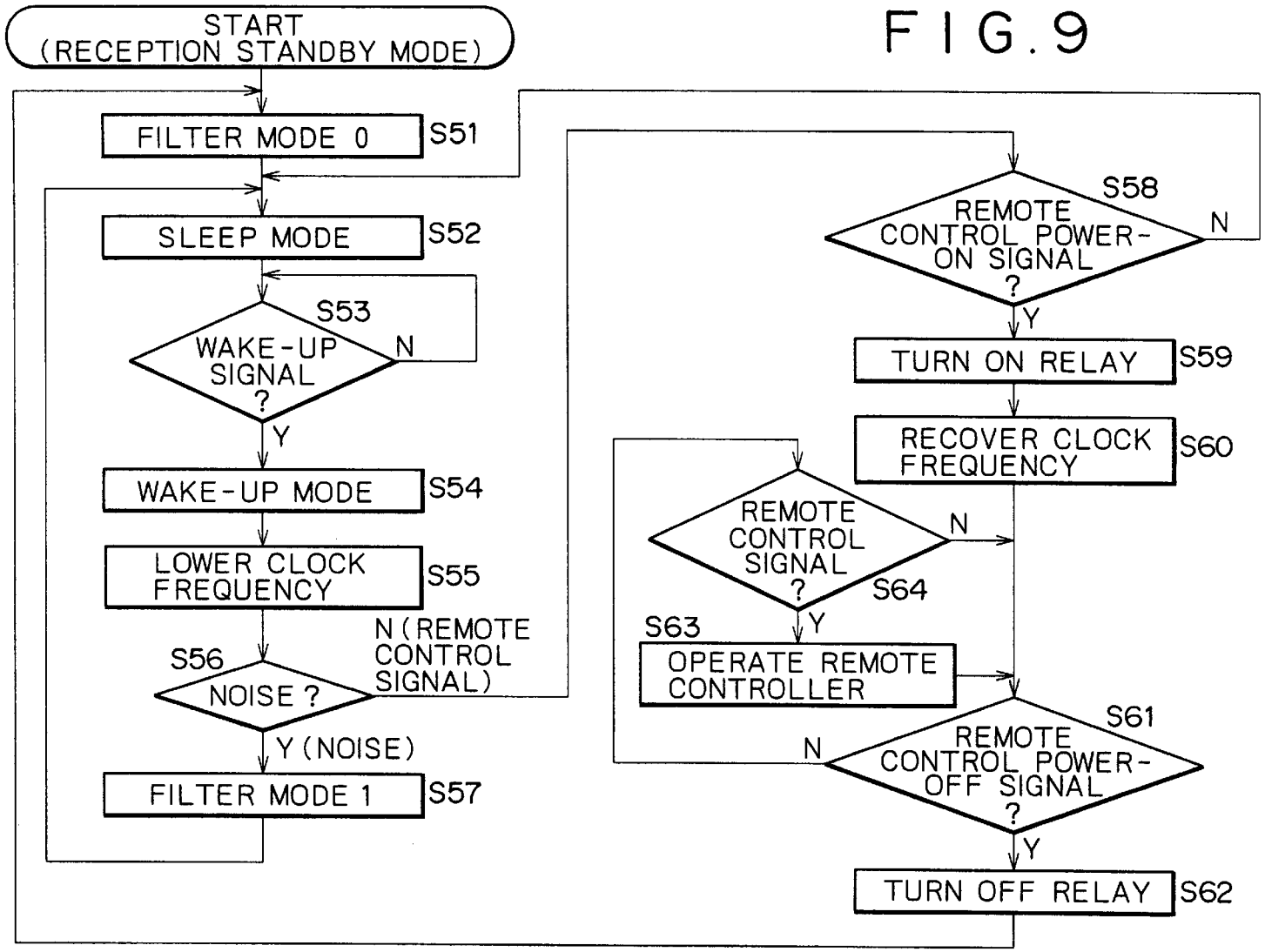
FIG. 9 is a flowchart of a remote control routine executed in the fifth embodiment of the present invention.

FIGS. 8 and 9 represent a fifth embodiment of the present invention, in which FIG. 8 shows only a light sensor 11 and peripheral circuits around a controlling microcomputer 30. As other component parts are the same as those in the first embodiment, a repeated explanation thereof is omitted here. FIG. 9 is a flowchart of a control routine executed in the microcomputer 30.

A first feature of the fifth embodiment resides in that, as shown in FIG. 8, a filter 20 has a capacitor $C_1$ and another capacitor $C_2$ of a greater capacitance, whereby its filtering function is enhanced against noise. Such two capacitors $C_1$ and $C_2$ are controlled individually via, e.g., filter control terminals $T_{2a}$ and $T_{2b}$ respectively. Hereinafter one state where the capacitor $C_1$ is connected to constitute the filter 20 will be termed "mode 0", and another state where the capacitor $C_2$ is connected to constitute the filter 20 will be termed "mode 1".

And a second feature of the fifth embodiment resides in that, when the controlling microcomputer 30 in its reception standby state has been shifted from the sleep mode to the wake-up mode, the frequency of a clock source 31 used in the controlling microcomputer 30 is lowered to 1/2 or 1/3, and in a subsequent power on-state, the clock frequency is changed to its former normal value, so that the controlling microcomputer 30 is operated in a power saving condition.

Although the above two features are effective to achieve advantageous results if carried out separately, an explanation will be given below on an example where such two features are carried out simultaneously.

The control routine of FIG. 9 starts as in FIG. 2, and it is supposed now that the controlling microcomputer 30 has been set in its reception standby state. At step S51, there is selected a filter mode 0 where the capacitor $C_1$ is connected to constitute the filter 20. And at step S52, the controlling microcomputer 30 is set in the sleep mode. Thereafter at step S53, a decision is made as to whether a wake-up signal is existent or not. In this sleep mode, the controlling microcomputer 30 is in a clock halt state, where the interrupt input terminal $T_5$ recognizes only a guide pulse signal included in the remote control signal. When the guide pulse signal inputted to the terminal $T_5$ via the filter 20 has been regarded as a wake-up signal, the controlling microcomputer 30 is shifted, at step S54, from the sleep mode to the wake-up mode. And subsequently at step S55, the clock frequency is lowered to 1/2 or 1/3 of the normal frequency to thereby attain a power saving mode. Even when the result of the decision at step S53 signifies that a wake-up signal has been inputted to the controlling microcomputer 30, if the noise alone is detected at step S56 without succeeding input of a remote control signal, the foregoing wake-up signal is regarded as noise, and there is selected, at step S57, a filter mode 1 where the filtering function is enhanced, and then the operation returns to the sleep mode.

At step S56, a decision is made as to whether the control signal is noise or not. When the noise is not detected, a decision is made, at step S58, as to whether a power-on signal is existent or not. And if the result of a decision at step S58 signifies that a power-on signal is existent, the relay is driven at steps S59 and S60 to resume the former normal clock frequency.

Thereafter, if the result of a decision at step S61 signifies that a power-off signal is existent, the relay is turned off at step S62, and then the operation returns to its start. Meanwhile, if the above result signifies that a power-off signal is not existent, the processes at steps S64–S61 or S64–S63–S61 are executed repeatedly until a detection of a power off signal.

In this embodiment, therefore, the decision for wake-up can be changed in accordance with the noise level to consequently realize further improvement for prevention of any malfunction that may be induced by noise.

The filter mode may altered to mode 0, mode 1, mode n by adding capacitors of further greater capacitances to sequentially enhance the filtering function. Mode 0 may be executed without any filter.

In any embodiment of the present invention, the filter unit may be composed of low pass filters or can be replaced by a circuit capable of discriminating the pulse width.

Moreover, in the sleep mode, the frequency characteristic of the light sensor 11 may be suppressed under control to achieve the desired filtering effect, hence eliminating the necessity of a filter circuit.

Although the present invention has been described hereinabove with reference to some preferred embodiments thereof, it is to be understood that the invention is not limited to such embodiments alone, and a variety of other changes and modifications will be apparent to those skilled in the art without departing from the spirit of the invention.

The scope of the invention, therefore, is to be determined solely by the appended claims.

What is claimed is:

1. An electronic apparatus comprising:

a low-pass filter for attenuating a high frequency component of a remote control signal composed of a guide pulse and a succeeding control code; and a control unit for decoding said control code in said remote control signal transmitted to said control unit via said filter and upon deciding that said remote control signal is a power cutoff instruction, demagnetizing a relay, thereby placing said electronic apparatus in a reception standby mode, while outputting a filter control signal to actuate said filter and setting said control unit in a low power state, wherein upon said control unit detecting said guide pulse while in said low power state, said control unit release itself from said low power state and said filter control signal deactivates said filter.

2. An electronic apparatus comprising:

a filter for attenuating a predetermined frequency component of a remote control signal composed of a fixed-width pulse and a succeeding control code; and a control unit for decoding said remote control signal supplied via a first input terminal and upon deciding that said remote control signal is a power cutoff instruction, demagnetizing a relay to place said electronic apparatus in a reception standby mode and to set said control unit in a low power state, thereby disabling said first input terminal from accepting said remote control signal, wherein when said fixed-width pulse included in said remote control signal supplied via said filter has been received at a second input terminal, said control unit is released from said low power state and enables said first input terminal to accept said remote control signal again.

3. The electronic apparatus according to claim 2, wherein when said control code is not existent within a predetermined time after said release from said low power state, said control unit outputs another filter control signal for further enhancing said frequency attenuating function of said filter, and said control unit is placed in said low power state again.

4. The electronic apparatus according to claim 1 or claim 2, wherein said low power state is obtained by halting a clock or execution of an instruction in said control unit.

5. A remote control method for an electronic apparatus, comprising the steps of:

attenuating using a low-pass filter a high-frequency component of a remote control signal composed of a guide pulse having a pulse width sufficient to be passed by the low-pass filter in said step of attenuating and a succeeding control code;

deciding that said remote control signal is a valid remote control signal by receiving the guide pulse passed by the low-pass filter and decoding the control code to form a power cutoff instruction to set a control unit in a low power state;

demagnetizing a relay to place said electronic apparatus in a reception standby mode; and releasing said control unit from said low power state and halting said step of attenuating upon detection of said guide pulse.

6. A remote control method for an electronic apparatus, comprising the steps of:

decoding a supplied remote control signal via a first input terminal, said supplied remote control signal composed of a fixed-width pulse and a succeeding control code and, upon deciding that said decoded control signal is a power cutoff instruction, demagnetizing a relay to place said electronic apparatus in a reception standby mode and to set a control unit in a low power state, and disabling said first input terminal from accepting said remote control signal;

attenuating a predetermined frequency component of said remote control signal; and deciding whether said fixed-width pulse included in said attenuated remote control signal is existent and, upon detection of said fixed-width pulse, releasing said control unit from said low power state and enabling said first input terminal to accept said remote control signal again.

7. The remote control method according to claim 6, further comprising a step of enhancing said attenuation of said predetermined frequency component if said control code is not existent within a predetermined time after a release of said control unit from said low power state, and subsequently placing said control unit in said low power state.

* * * * *